US005181004A

United States Patent [19]

Johnson

[11] Patent Number: 5,181,004

[45] Date of Patent: Jan. 19, 1993

[54] SOLENOID COIL ASSEMBLY

[75] Inventor: Kenric J. Johnson, Newport News, Va.

[73] Assignee: Siemens Automotive L.P., Auburn Hills, Mich.

[21] Appl. No.: 881,440

[22] Filed: May 11, 1992

[51] Int. Cl.[5] ..... H01F 27/26

[52] U.S. Cl. ..... 336/198; 29/606; 335/281; 336/234

[58] Field of Search ..... 336/234, 233, 83, 198, 336/208, 221; 310/216, 194; 29/602.1, 605, 607, 606, 609; 335/297, 281

[56] References Cited

U.S. PATENT DOCUMENTS 1,597,901 8/1926 Kent ..... 336/234

3,304,599 2/1967 Nordin ..... 336/83

*Primary Examiner*—Thomas J. Kozma

*Attorney, Agent, or Firm*—George L. Boller; Russel C. Wells

[57] ABSTRACT

A solenoid coil assembly comprises a bobbin containing an electromagnetic coil thereon, and a magnetically permeable conductor for conducting magnetic flux issued by said coil when energized. The magnetically permeable conductor is in the form of plural magnetically permeable U-shaped wires circumferentially arranged around the bobbin with one side of each wire disposed radially inwardly of the coil and the other side of each wire disposed radially outwardly of the coil. The sides of the wires pass through pre-formed holes in the bobbin.

10 Claims, 1 Drawing Sheet

SOLENOID COIL ASSEMBLY

FIELD OF THE INVENTION

This invention relates to generally to solenoids, and particularly to novel structure and method for the magnetic circuit of a solenoid coil assembly.

BACKGROUND AND SUMMARY OF THE INVENTION

Magnetically permeable material is frequently used in proximate association with a solenoid coil in order to provide a path for magnetic flux generated by the solenoid coil. Representative embodiments of such material comprise sleeves, tubes, pole pieces, etc. of suitable configuration. In order to minimize eddy current losses, such parts are often fabricated from laminations.

The present invention relates to a new and unique association of magnetically permeable material with a solenoid coil. The invention has both article (product) and method aspects. A solenoid coil embodying the inventive principles may be fabricated in a cost effective manner to minimize eddy current loss.

Features, advantages, and benefits of the invention will be seen in the ensuing detailed description of a presently preferred embodiment of the invention according to the best mode contemplated at this time for carrying out the invention. The description should be read in conjunction with accompanying drawings briefly described by as follows.

DESCRIPTION OF THE PREFERRED EMBODIMENT

Figure 1:
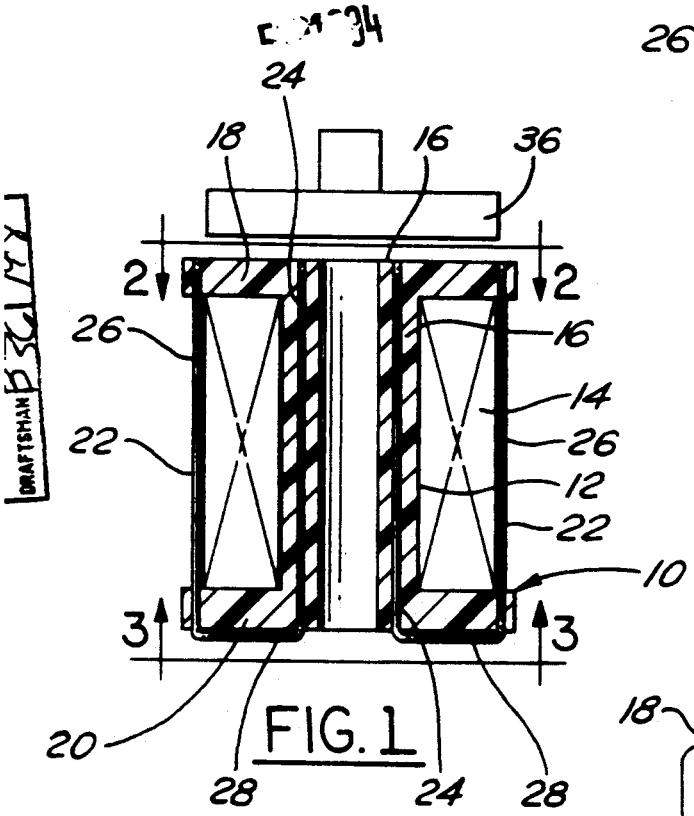
FIG. 1 is a longitudinal cross sectional view through a solenoid coil assembly embodying principles of the invention.
Figure 2:
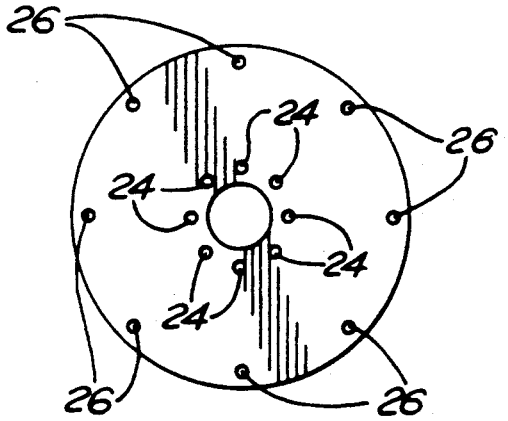
FIG. 2 is a view in the direction of arrows 2—2 in FIG. 1.
Figure 3:
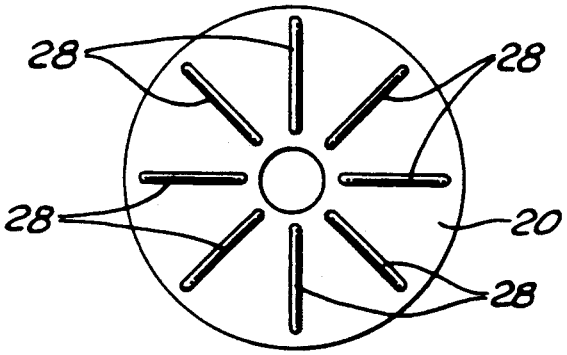
FIG. 3 is a view in the direction of arrows 3—3 in FIG. 1.

FIGS. 1, 2, and 3 illustrate a solenoid coil assembly 10 comprising a non-metallic bobbin 12 onto which a length of insulated wire has been wound to form a coil 14. (The electrical terminations of the coil do not appear in the drawings.) Bobbin 12 is typically a synthetic material such as an injection molded plastic. Bobbin 12 has a circular cylindrical tubular core 16 with circular flanges 18 and 20 at opposite axial ends.

In accordance with principles of the invention, a plurality of members, in the form of staples, 22 are associated with the solenoid coil assembly to provide a magnetic circuit path for magnetic flux issued by coil 14 when energized. Each staple 22 is basically U-shaped from a length of wire of suitable stiffness and comprises parallel side segments 24, 26 whose proximal ends are joined by a base segment 28 that is perpendicular to the side segments.

In the illustrated embodiment, there are eight staples arranged equally circumferentially spaced about, and in planes that are radial to, the coil axis. One side segment 24 of each staple is disposed radially inwardly of the coil while the other 26 is disposed radially outwardly. Holes are provided in bobbin 12 to accommodate the staples. There are eight axial through-holes 30 within core 16, eight through-holes 32 in flange 18, and eight through-holes 34 in flange 20. Side segments 24 pass through holes 30, while each side segment 26 passes through one hole 34 and the corresponding aligned hole 32. The distal ends of side segments 24, 26 are substantially flush with one axial end face of the bobbin while base segments 28 are disposed non-flush with the opposite axial end face of the bobbin. In use, the assembly 10 is associated with an armature, such as shown at 36 in FIG. 1, disposed to face the assembly's axial end that contains the distal ends of side segments 24, 26.

Staples 22 are of a suitable magnetically permeable material, such as a ferromagnetic wire. While the staples collectively provide a path for magnetic flux issued by the coil when energized, the fact that they are circumferentially spaced apart minimizes eddy currents in them, especially when compared to a circumferentially continuous ferromagnetic tube.

Figure 4:
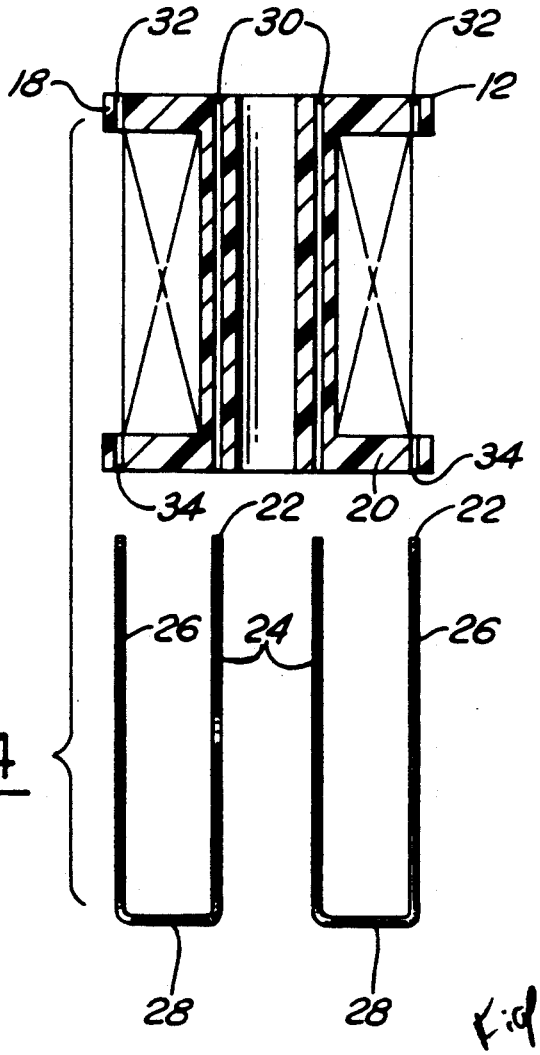
FIG. 4 is a view illustrating a step in the method of making the solenoid coil assembly.

The inventive method for assembling the staples to the assembly is as follows. FIG. 4 shows that holes 30, 32, and 34 are pre-formed in bobbin 12 before staples 22 are associated with it. The staples are aligned with the holes and then advanced into them until the position of FIG. 1 is attained. Thereafter, the assembly may be encapsulated, either wholly or selectively as desired, such encapsulation not being shown in the drawings. It is conceivable that the staples can be associated with the assembly in other ways, and thus still yield the inventive solenoid coil assembly without practicing the inventive method.

Since it will typically be important for the distal ends of the staples to occupy a common transverse plane, such as by the already described flushness with the one axial end face of the bobbin, other procedures may be employed to assure such occupancy irrespective of whether the transverse plane happens to coincide with that end face. For example, the staples may be somewhat longer and inserted until their distal ends abut a planar stop, or they may be ground to a common plane which may or may not be flush with the bobbin end face.

Any given assembly incorporating the inventive principles will of course be designed with the use of conventional engineering principles to achieve proper size, force, etc., and therefore it should be understood that the sizes, shapes, material, and numbers of staples used are subject to selection by appropriate engineering criteria.

Having described the invention, what is claimed is:

1. A solenoid coil assembly comprising a bobbin containing an electromagnetic coil thereon, and a magnetically permeable conductor for conducting magnetic flux issued by said coil when energized, characterized in that said magnetically permeable conductor comprises plural magnetically permeable wires circumferentially arranged around said bobbin, each of said wires comprises side segments that have distal ends and that are joined together at proximal ends by a base segment, one of said side segments of each wire is disposed radially inwardly of said coil and the other of said side segments of each wire is disposed radially outwardly of said coil, and at least one of said side segments of each wire passes through a corresponding hole in said bobbin.

2. A solenoid coil assembly as set forth in claim 1 characterized further in that both side segments of each wire pass through respective corresponding holes in said bobbin.

3. A solenoid coil assembly as set forth in claim 1 characterized further in that each of said wires occupies a plane that is radial to said coil.

4. A solenoid coil assembly as set forth in claim 1 characterized further in that said distal ends of each wire occupy a common plane that is transverse to said coil.

5. A solenoid coil assembly as set forth in claim 5 characterized further in that said distal ends of each wire occupy a common plane that is transverse to said coil and are substantially flush with an axial end face of said bobbin.

6. A method of making a solenoid coil assembly comprising a bobbin containing an electromagnetic coil thereon, and a magnetically permeable conductor for conducting magnetic flux issued by said coil when energized, characterized by providing for said magnetically permeable conductor plural magnetically permeable wires, each of which comprises side segments that have distal ends and that are joined together at proximal ends by a base segment, circumferentially arranging said wires around said bobbin just beyond one axial end thereof, and then advancing said wires axially relatively toward said bobbin so as to insert said wires into association with said bobbin to dispose one of said side segments of each wire radially inwardly of said coil and the other of said side segments of each wire radially outwardly of said coil and finally passing at least one of said side segments of each wire through a corresponding hole in said bobbin.

7. A method as set forth in claim 6 characterized further in that both side segments of each wire pass through said respective corresponding holes in said bobbin during such axial advancement.

8. A method as set forth in claim 6 characterized further in that each of said wires is advanced in a corresponding plane that is radial to said coil.

9. A method as set forth in claim 6 characterized further in that each of said wires is advanced in a position wherein said distal ends of each wire are caused to occupy a common plane that is transverse to said coil.

10. A method as set forth in claim 9 characterized further in that each of said wires is advanced to a final position wherein said distal ends of each wire are caused to occupy a common plane that is substantially flush with an axial end face of said bobbin.

* * * * *